US008472650B2

(12) United States Patent
Lee

(10) Patent No.: US 8,472,650 B2
(45) **Date of Patent: *Jun. 25, 2013**

(54) ELECTRO-ACOUSTIC TRANSDUCER

(75) Inventor: Fang-Ching Lee, Taoyuan County (TW)

(73) Assignee: HTC Corporation, Taoyuan (TW)

( * ) Notice: Subject to any disclaimer, the term of this patent is extended or adjusted under 35 U.S.C. 154(b) by 449 days.

This patent is subject to a terminal disclaimer.

(21) Appl. No.: 12/578,258

(22) Filed: Oct. 13, 2009

(65) Prior Publication Data

US 2010/0092013 A1 Apr. 15, 2010

Related U.S. Application Data

(63) Continuation-in-part of application No. 12/422,484, filed on Apr. 13, 2009, now Pat. No. 8,243,965.

(30) Foreign Application Priority Data

Oct. 15, 2008 (TW) ..... 97139491 A

(51) Int. Cl.
*H04R 25/00* (2006.01)

(52) U.S. Cl.
USPC ..... 381/191

(58) Field of Classification Search
USPC ..... 381/191
See application file for complete search history.

(56) References Cited

U.S. PATENT DOCUMENTS

| | | | | |
|---|---|---|---|---|
| 1,759,810 | A | 5/1930 | Edelman | |
| 1,767,657 | A | 6/1930 | Edelman | |
| 2,896,025 | A | 7/1959 | Janzen et al. | |
| 3,930,128 | A * | 12/1975 | Fidi et al. | 381/174 |
| 4,160,881 | A * | 7/1979 | Smulders | 310/357 |
| 8,243,965 | B2 * | 8/2012 | Lee | 381/191 |
| 2007/0195976 | A1 | 8/2007 | Sekino et al. | |
| 2010/0092012 | A1 * | 4/2010 | Lee | 381/191 |

FOREIGN PATENT DOCUMENTS

| | | | |
|---|---|---|---|
| CN | 101203066 | A | 6/2008 |
| EP | 2150075 | A2 | 2/2010 |
| EP | 2182737 | A1 | 5/2010 |
| GB | 1262505 | | 2/1972 |
| TW | I293233 | B | 2/2008 |

* cited by examiner

*Primary Examiner* — Charles Garber
*Assistant Examiner* — Reema Patel
(74) *Attorney, Agent, or Firm* — Birch, Stewart, Kolasch & Birch, LLP

(57) ABSTRACT

An electro-acoustic transducer is disclosed. The electro-acoustic transducer includes an electret diaphragm, an orifice plate and a plurality of dividing structures. Each of the dividing structures, disposed between the electret diaphragm and the orifice plate, includes at least one main portion, and the number of the main portion is a positive integer. When the number of the main portion is larger than one, the main portions are respectively connected to a center and extended radially from the center.

16 Claims, 8 Drawing Sheets

ELECTRO-ACOUSTIC TRANSDUCER

This application is a Continuation-In-Part of application Ser. No. 12/422,484, filed Apr. 13, 2009 now U.S. Pat. No. 8,243,965, which claims priority of Taiwan Patent Application No. 097139491, filed on Oct. 15, 2008, the entirety of which is incorporated by reference herein.

BACKGROUND OF THE INVENTION

1. Field of the Invention

The invention relates to an electro-acoustic transducer, and more particularly, to an electro-acoustic transducer characterized by an increased volume output and extension of low frequencies.

2. Description of the Related Art

A dividing material of an electro-acoustic transducer is utilized to separate an electret diaphragm and an orifice plate in order to maintain a vibrating space therebetween. When charged with electricity, the electret diaphragm is able to vibrate according to an input signal.

FIG. 1 is a schematic view of an electro-acoustic transducer 10. In a conventional electro-acoustic transducer 10, the dividing material 13, usually plaid shaped, protrudes from the orifice plate 11. When the electret diaphragm 12 is disposed on the orifice plate 11, the electret diaphragm 12 contacts the plaid shaped dividing material 13 to form rectangular spaces P therebetween for vibration. However, the rectangular spaces P are formed by four solid walls, limiting vibration of the electret diaphragm 12. In other words, the vibrating space required by the electret diaphragm 12 is limited by the dividing material 13, resulting in a decreased volume output and limited extension of low frequencies.

BRIEF SUMMARY OF THE INVENTION

The invention discloses an electro-acoustic transducer. The electro-acoustic transducer includes an electret diaphragm, an orifice plate and a plurality of dividing structures. Each of the dividing structures, disposed between the electret diaphragm and the orifice plate, includes at least one main portion, and the number of the main portion is a positive integer. When the number of the main portion is larger than one, the main portions are respectively connected to a center and extended radially from the center.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 1:
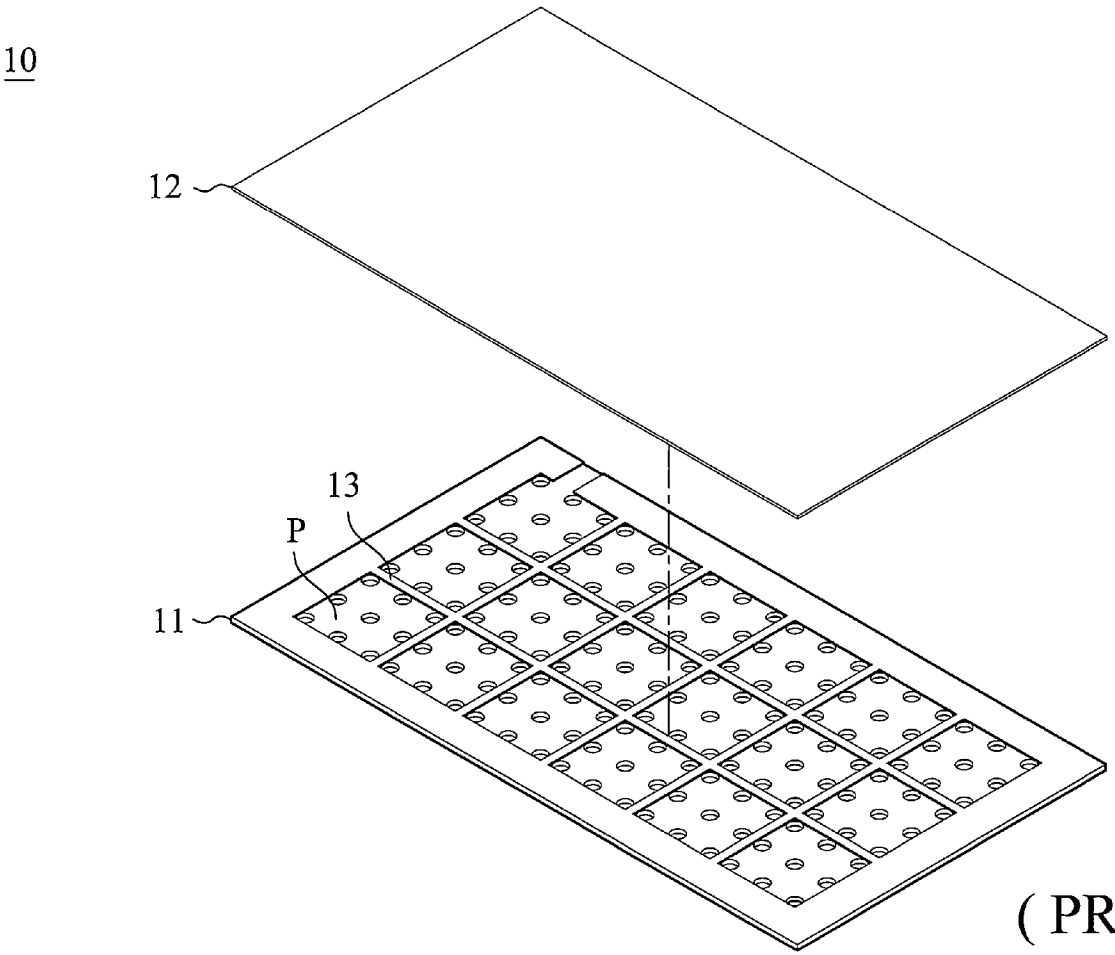
FIG. 1 ( PRIOR ART )
FIG. 1 is a schematic view of a conventional electro-acoustic transducer.
Figure 2:
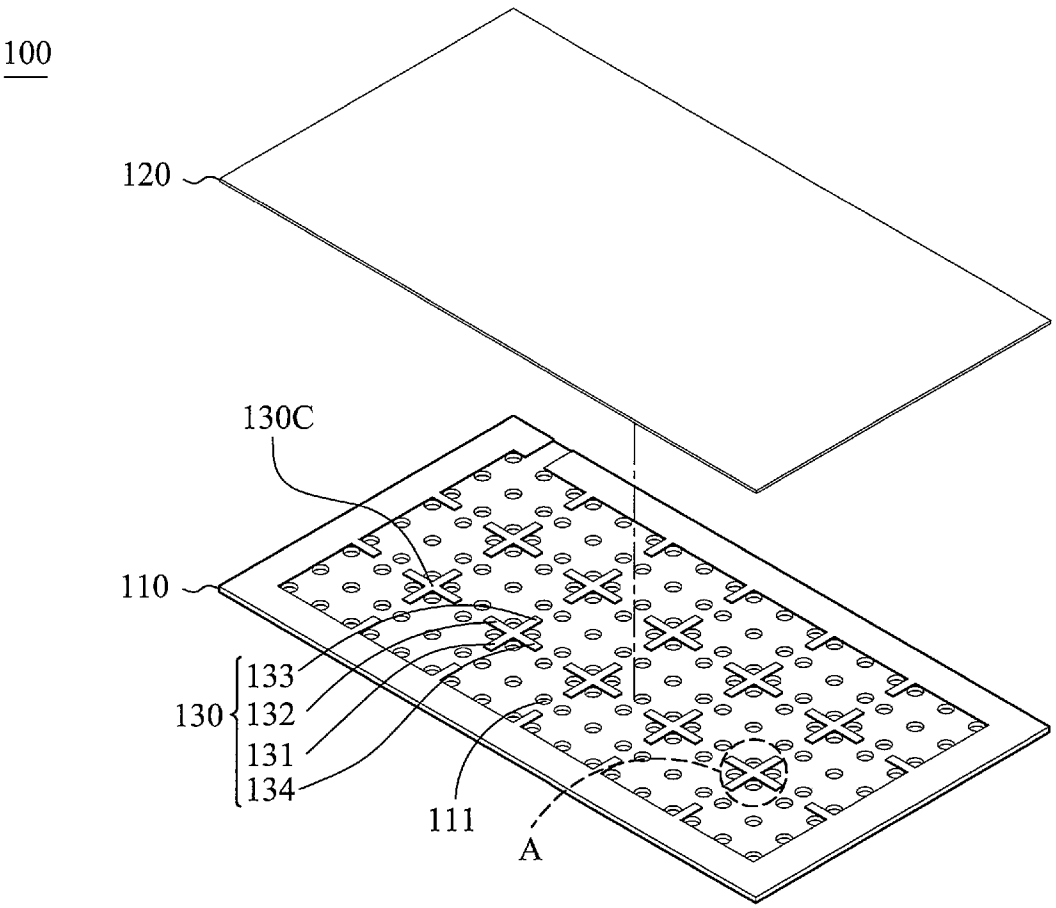
FIG. 2 is a schematic view of an electro-acoustic transducer of the invention.
Figure 3:
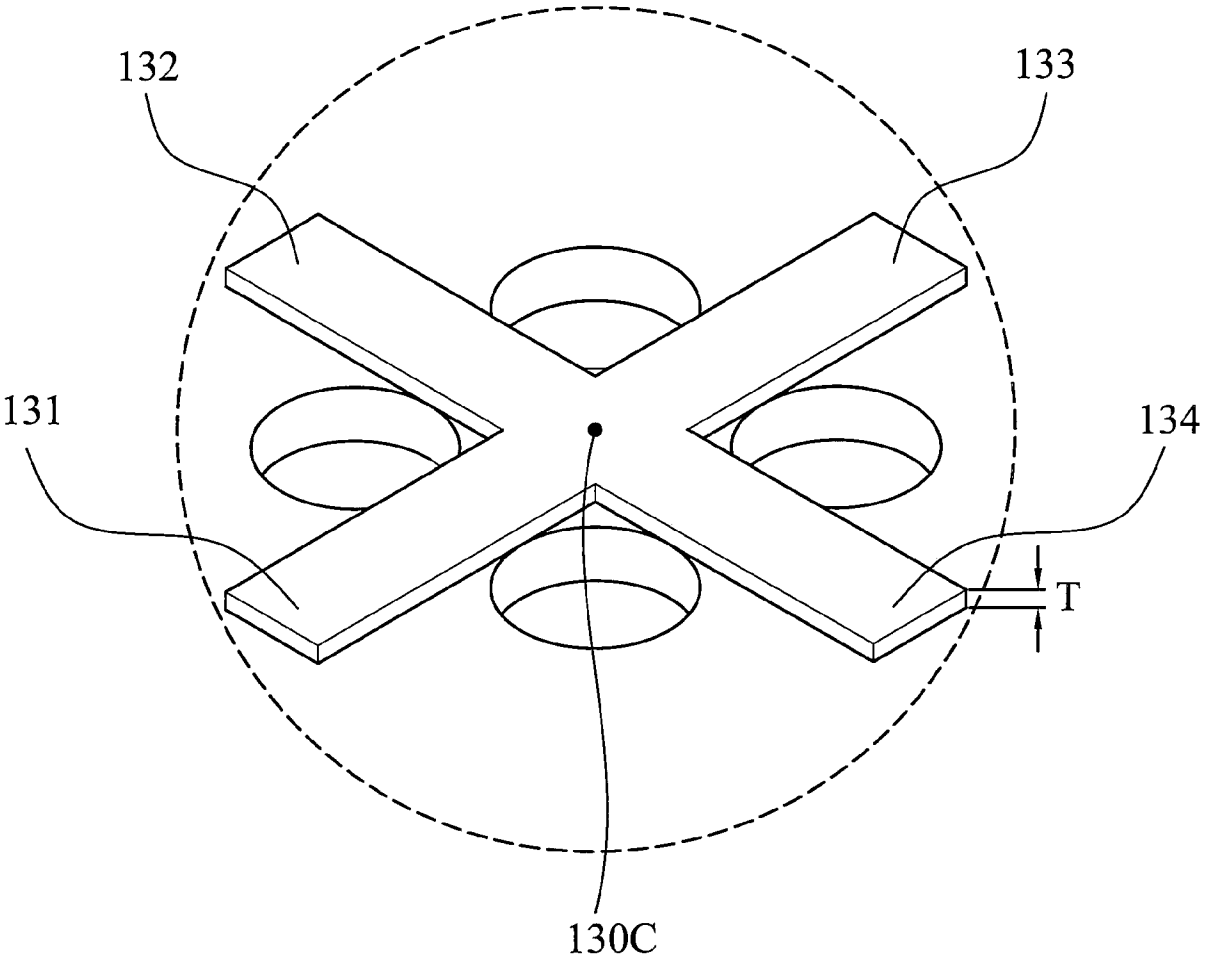
FIG. 3 is an enlarged view of portion A in FIG. 2.
Figure 4:
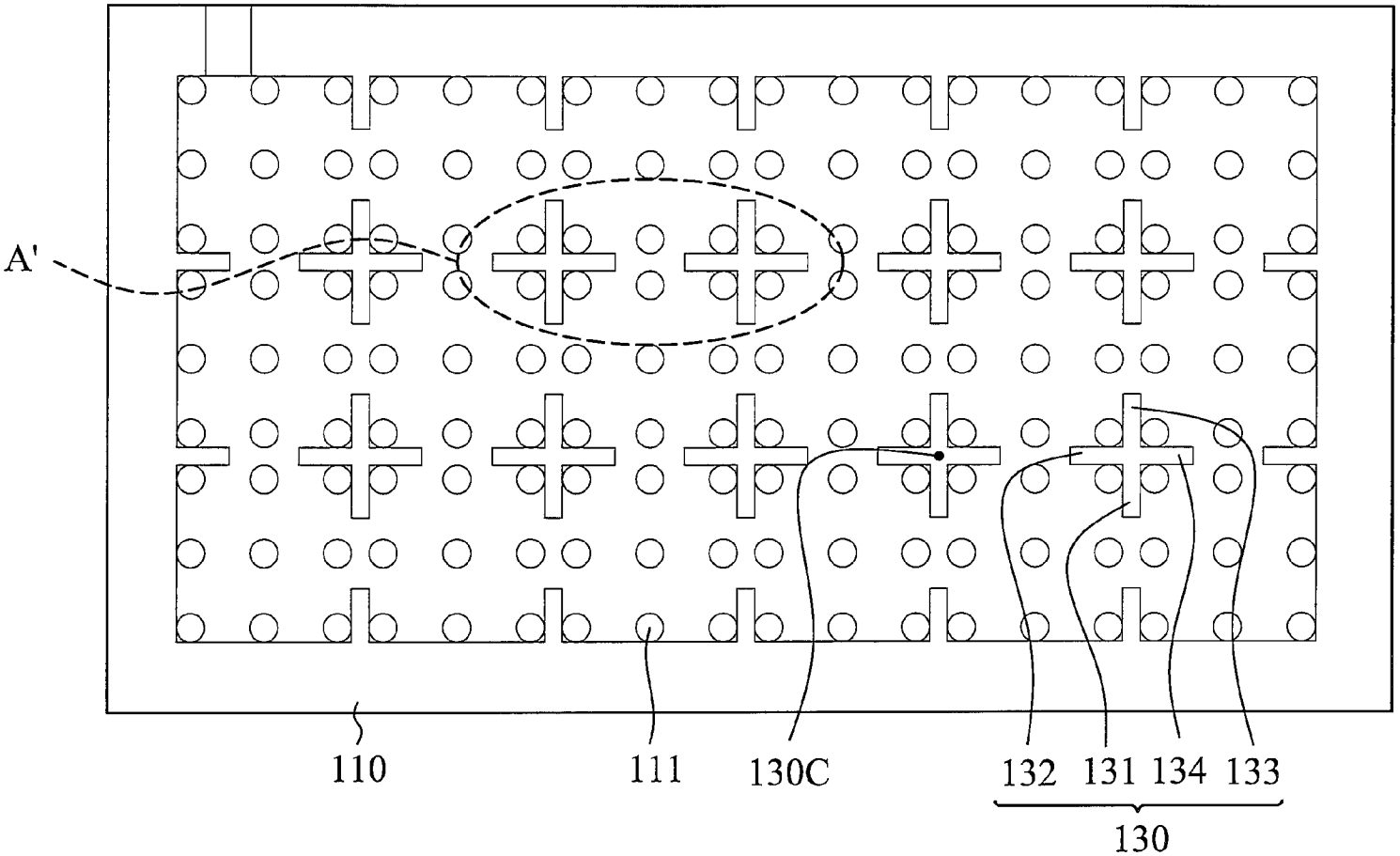
FIG. 4 is a top view of an orifice plate of the electro-acoustic transducer of the invention.
Figure 5:
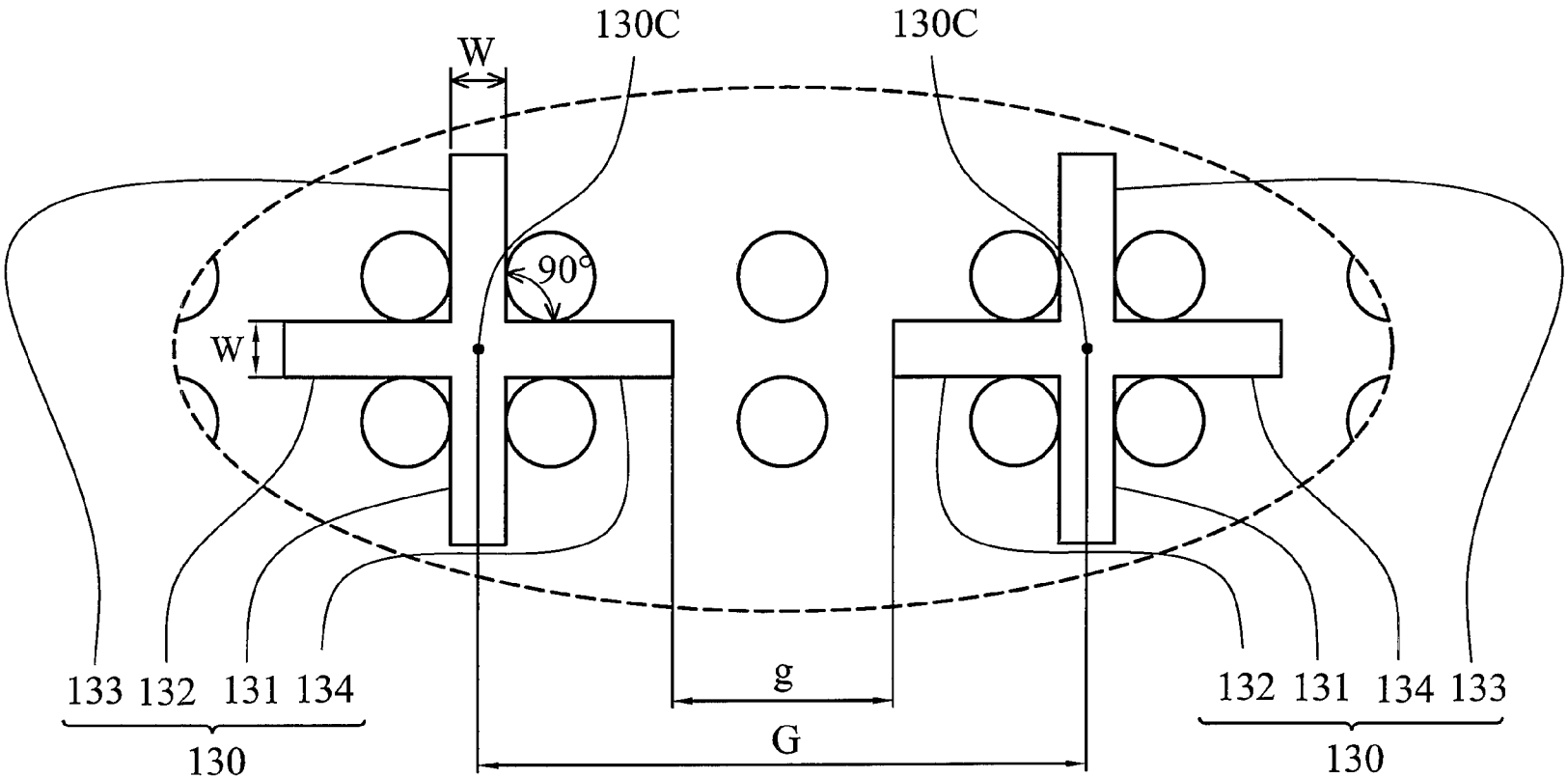
FIG. 5 is an enlarged view of portion A' in FIG. 4.

FIG. 2 is a schematic view of an electronic device of the invention; FIG. 3 is an enlarged view of portion A in FIG. 2;

FIG. 4 is a top view of the electronic device of the invention; and FIG. 5 is an enlarged view of portion A' in FIG. 4.

Referring to FIGS. 2 and 4, the electro-acoustic transducer 100 of the embodiment comprises an orifice plate 110, an electret diaphragm 120 and a plurality of dividing structures 130. The orifice plate 110 comprises a plurality of orifices 111, and the orifices 111 occupy 5~40% of the orifice plate 110, wherein the orifices 111 are circular-shaped or other shapes. The electret diaphragm 120 and the orifice 110 are separated by the dividing structures 130. It should be noted that the dividing structures 130 are disposed on the orifice plate 110 or it can be formed integrally with the orifice plate 110. Additionally, the dividing structures 130 are arranged in a matrix (as shown in FIG. 4).

Referring to FIGS. 3 and 5, the dividing structures 130, which are cross-shaped, comprise four main portions 131, 132, 133 and 134. The four main portions 131, 132, 133 and 134 are perpendicular to each other to form 90-degree angles therebetween, and extend radially from a center 130C. Additionally, one of the main portions of a dividing structure 130 corresponds to one of the main portions of another dividing structure 130. In the embodiment, the main portion 134 of the dividing structure 130 on the left corresponds to the main portion 132 of the dividing structure 130 on the right (as shown in FIG. 5) A first distance G is formed between the centers 130C of the two adjacent dividing structures 130. A second distance g is formed between the main portions of the two adjacent dividing structures 130. The ratio of the first distance G to the second distance g is 5:2 or 5:3. For example, when the first distance G is 10 mm, the second distance g is 4 mm or 6 mm and when the first distance G is 15 mm, the second distance g is 6 mm or 9 mm. Meanwhile, the first distance G is preferably between 5 mm to 50 mm.

In addition, the main portions 131, 132, 133 and 134 respectively have a width W (as shown in FIG. 5) and a thickness T (as shown in FIG. 3). The width W of the main portions 131, 132, 133, 134 is 1 mm, and the thickness T is derived from a formula: $T(\mu m)=(10\times G\ (mm)+100)\pm 20\%$. In other words, when the first distance G is 10 mm, the thickness T of the main portions 131, 132, 133 and 134 is 200 μm±20%, when the first distance G is 7 mm, the thickness T of the main portions 131, 132, 133 and 134 is 170 μm±20%, and when the first distance G is 15 mm, thickness T of the main portions 131, 132, 133, 134 is 250 μm±20%.

Note that if the size and distance (1 mm) between the two dividing structures (dividing materials) are the same, the volume output of the electro-acoustic transducer of the embodiment would be increased by 6 dB when compared with the conventional electro-acoustic transducer.

In the above embodiment, the dividing structure 130 comprises four main portions, but it is not limited thereto. The dividing structure 130 may comprise only one main portion, two main portions, three main portions, or even more than three main portions, as long as the number of the main portions is a positive integer. Moreover, the characteristics of the main portions and the distance relationships therebetween, as defined in the previous embodiment, are present for used main portions of any positive integers.

Figure 6:
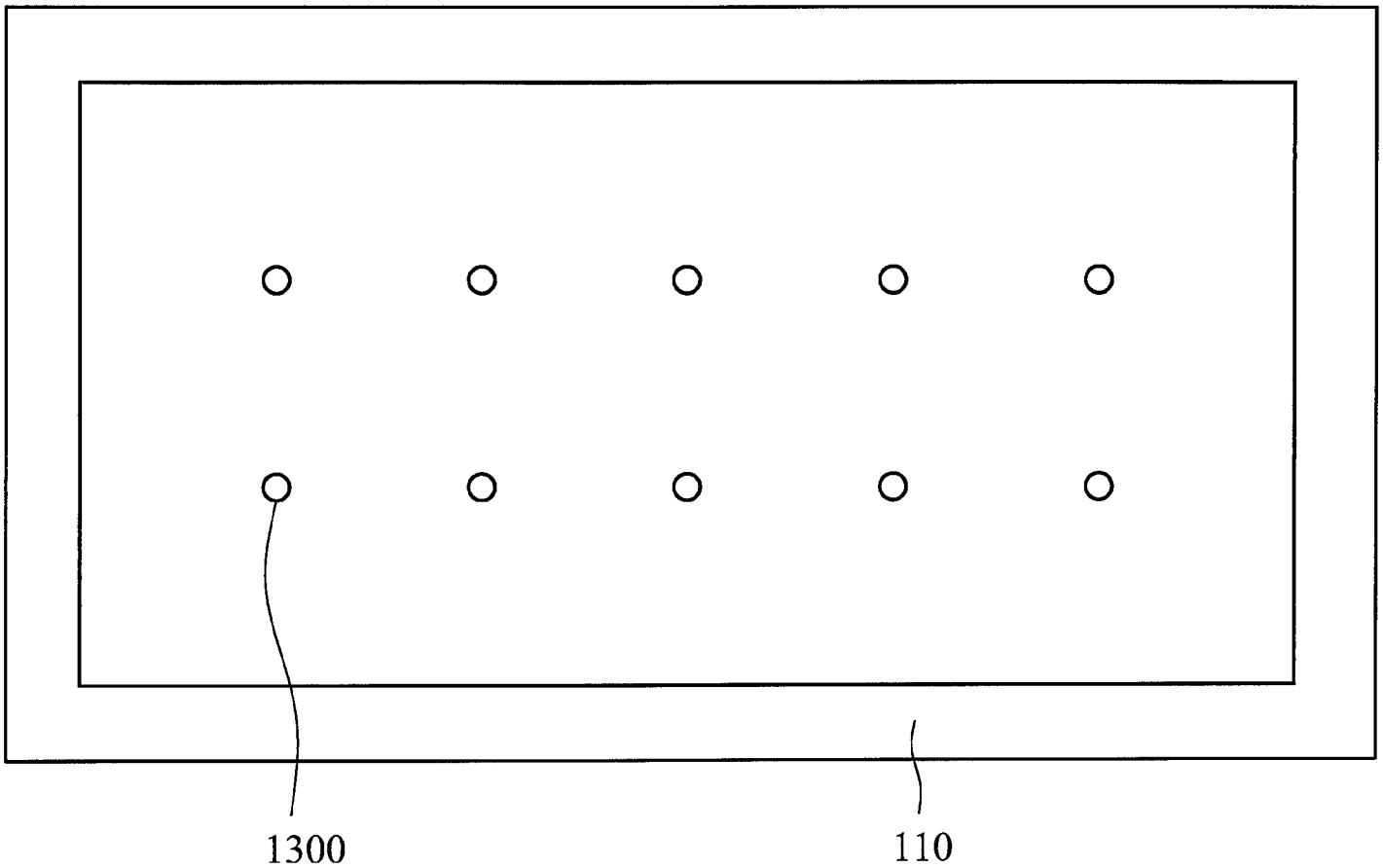
FIGS. 6-8 are schematic views showing variant embodiments of the orifice plate of the electro-acoustic transducer.
Figure 7:
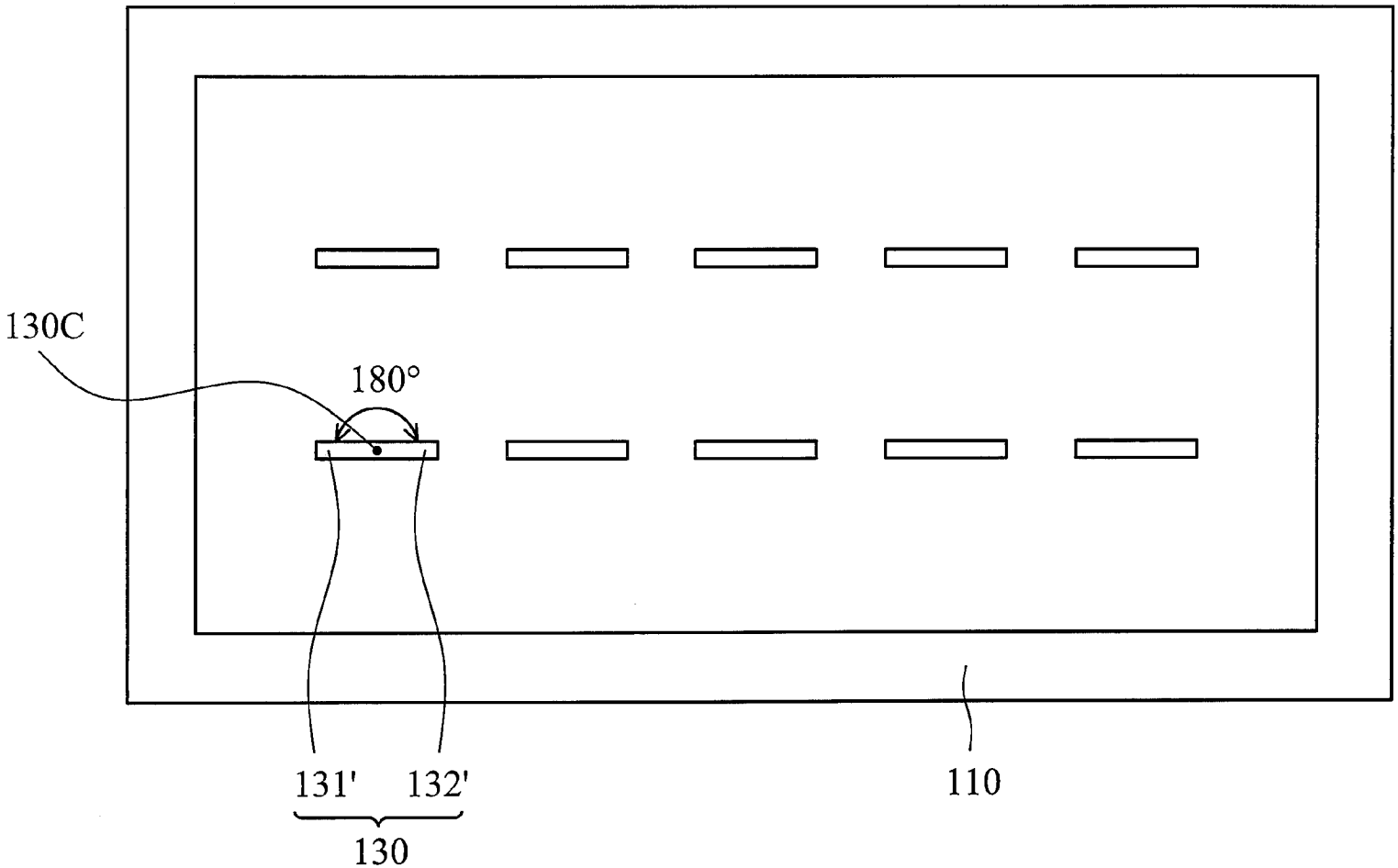
Figure 8:
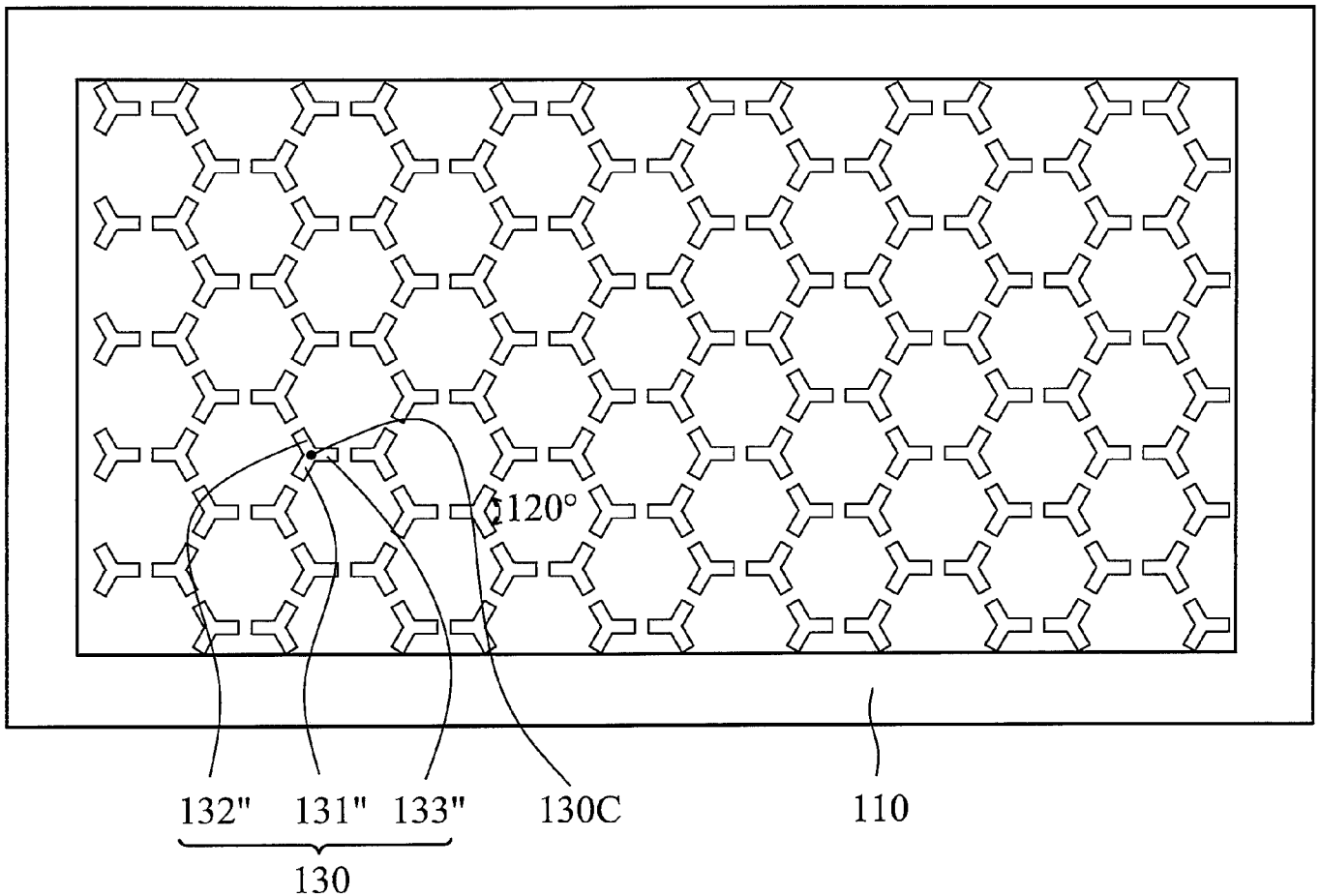

As shown in FIG. 6, the dividing structure only comprises one main portion 1300 with a width of 1 mm. When the number of the main portions is N, which is a positive integer greater than one, angles formed between the main portions are equal to 360°/N. As shown in FIG. 7, the dividing structure 130 comprises two main portions 131' and 132' extending radially from the center 130C, and 180-degree angles are formed between the main portion 131' and the main portion 132'. As shown in FIG. 8, the dividing structure 130 comprises three main portions 131", 132" and 133" extending radially from the center 130C, and 120-degree angles are formed between the main portions 131", 132" and 133". Similarly, when there are five main portions, 72-degree angles are formed therebetween, and when there are six main portions, 60-degree angles are formed therebetween. The characteristics of the main portions, such as the thickness and the width, and the distance relationships, such as the first distance and the second distance, therebetween are defined in the previous embodiment.

No matter how many main portions are used in a single dividing structure of the electro-acoustic transducer of the embodiment, the contact area between the electret diaphragm and the dividing structures is reduced when compared to the conventional electro-acoustic transducer, thereby increasing an effective vibrating area. According to experimentation, when the dividing structure 130 comprises three main portions (as shown in FIG. 8) or four main portions (as shown in FIG. 4), the sensitivity of the electret diaphragm is increased by 40%, and the low frequency of the electro-acoustic transducer is further extended. Particularly, when the dividing structure 130 comprises three main portions (as shown in FIG. 8), the high frequency of the electro-acoustic transducer is further extended to beyond 15 KHz as compared to the conventional frequency span of 12 KHz.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An electro-acoustic transducer, comprising:

an electret diaphragm;

an orifice plate comprising a plurality of orifices; and a plurality of dividing structures disposed between the electret diaphragm and the orifice plate, wherein each of the dividing structures is spaced apart from each other and comprises a plurality of main portions respectively connected to a center of the dividing structure and extended radially along the orifice plate from the center.

2. The electro-acoustic transducer as claimed in claim 1, wherein when the number of the main portion is N, which is a positive integer greater than 1, angles formed between the main portions are 60°/N.

3. The electro-acoustic transducer as claimed in claim 1, wherein angles formed between the adjacent main portions are equal.

4. The electro-acoustic transducer as claimed in claim 1, wherein each of the dividing structure comprises four main portions, and 90-degree angles are formed therebetween.

5. The electro-acoustic transducer as claimed in claim 1, wherein the dividing structures are disposed on the orifice plate, or are formed integrally with the orifice plate.

6. The electro-acoustic transducer as claimed in claim 1, wherein the dividing structures are arranged in a matrix.

7. The electro-acoustic transducer as claimed in claim 1, wherein a first distance is formed between the two adjacent centers.

8. The electro-acoustic transducer as claimed in claim 7, wherein the first distance is substantially 10 mm.

9. The electro-acoustic transducer as claimed in claim 7, wherein the first distance is between 5 mm to 50 mm.

10. The electro-acoustic transducer as claimed in claim 7, wherein each of the dividing structures has a thickness derived from a formula: $T(\mu m)=(10\times G(mm)+100)\pm 20\%$, wherein T represents the thickness and G represents the first distance.

11. The electro-acoustic transducer as claimed in claim 7, wherein a second distance is formed between the main portions of the two adjacent dividing structures, and the ratio of the first distance to the second distance is 5:2.

12. The electro-acoustic transducer as claimed in claim 7, wherein a second distance is formed between the main portions of the two adjacent dividing structures, and the ratio of the first distance to the second distance is 5:3.

13. The electro-acoustic transducer as claimed in claim 7, wherein each of the main portions has a width of 1 mm.

14. The electro-acoustic transducer as claimed in claim 1, wherein the orifices occupy 5%~40% of the orifice plate.

15. The electro-acoustic transducer as claimed in claim 1, wherein the orifices are circular-shaped or other shapes.

16. The electro-acoustic transducer as claimed in claim 1, wherein every two adjacent main portions of each dividing structure are configured to be provided with one of the plurality of orifices disposed therebetween.

* * * * *